United States Patent [19]

Hament

[11] 4,319,691

[45] Mar. 16, 1982

[54] CUP LID

[76] Inventor: Erwin Hament, 5322 Roosevelt Ave., Woodside, N.Y. 11377

[21] Appl. No.: 209,685

[22] Filed: Nov. 24, 1980

[51] Int. Cl.[3] ..... A47G 19/22; B65D 41/26

[52] U.S. Cl. ..... 220/90.4; 229/7 R; 229/43

[58] Field of Search ..... 222/562, 570; 220/90.2, 220/90.4; 229/7 R, 43

[56] References Cited

U.S. PATENT DOCUMENTS 4,187,954 2/1980 Striggow ..... 220/90.4

*Primary Examiner*—Allan N. Shoap

*Attorney, Agent, or Firm*—McAulay, Fields, Fisher, Goldstein & Nissen

[57] ABSTRACT

The cup lid for fitting the lip of a cup comprises a first circular sealing flange fittable over an entire circumference of the lip and effective to seal the cup against spillage of spillable material therefrom, a second circular sealing flange intersecting the first circular sealing flange fittable over the lip and forming together with the first circular sealing flange a figure-8 outline, an opening in the cup lid outside the first circular sealing flange and inside the second circular sealing flange, the opening being effective to dispense material from the cup when the second circular flange is fitted over the lip.

3 Claims, 3 Drawing Figures

CUP LID

This invention relates generally to cup lids and, more particularly, to cup lids which provide an opening through which fluid or the material therein may be dispensed.

A continuing problem in our modern mobile society occurs when one stops for a cup of coffee during an automobile trip. It is not possible to just buy a cup of coffee and drive away drinking the coffee as one drives. Even smooth roads disturb the coffee sufficiently to slosh it over the edge at least until the fluid level in the cup has been reduced well below the lip. The same problem occurs in carrying a cup of coffee.

In order to avoid spilling, it has been conventional to employ a cap fitting over the lip of the cup. Once sealed in this way, it is not convenient to dispense liquid from the cup without removing the cap entirely. This, of course, returns to the problem of sloshing over the top.

One prior solution has included a cap with an opening near its sealing flange which is either formed during manufacture of the cup or is defined by perforations which the user can employ to remove a strip of material for creating the opening. This partially solves the problem since the smaller opening reduces, but does not eliminate, the tendency of the coffee to slosh out.

With the opening originally provided, or created by tearing along perforations, there is customarily no way for resealing the cup.

Accordingly, an object of this invention is to provide an improved cup lid which overcomes the drawbacks of the prior art.

A more specific object of the present invention is to provide a cup lid which permits sealing the top of a cup or partially sealing it while providing a dispensing aperture at the lip.

A further object of the invention is to provide a cup lid having first and second intersecting sealing channels wherein one of the channels is continuous and seals the top of the cup and the second channel includes an opening in the edge thereof for dispensing contents of the cup.

According to an aspect of the present invention, there is provided a cup lid for fitting the lip of a cup comprising a first circular sealing flange fittable over an entire circumference of the lip and effective to seal the cup against spillage of spillable material therefrom, a second circular sealing flange intersecting the first circular sealing flange fittable over the lip and forming together with the first circular sealing flange a figure-8 outline, an opening in the cup lid outside the first circular sealing flange and inside the second circular sealing flange, the opening being effective to dispense material from the cup when the second circular flange is fitted over the lip.

Other features and advantages of the present invention will become apparent from a consideration of the following detailed description when taken in conjunction with the accompanying drawings, in which.

Figure 1:
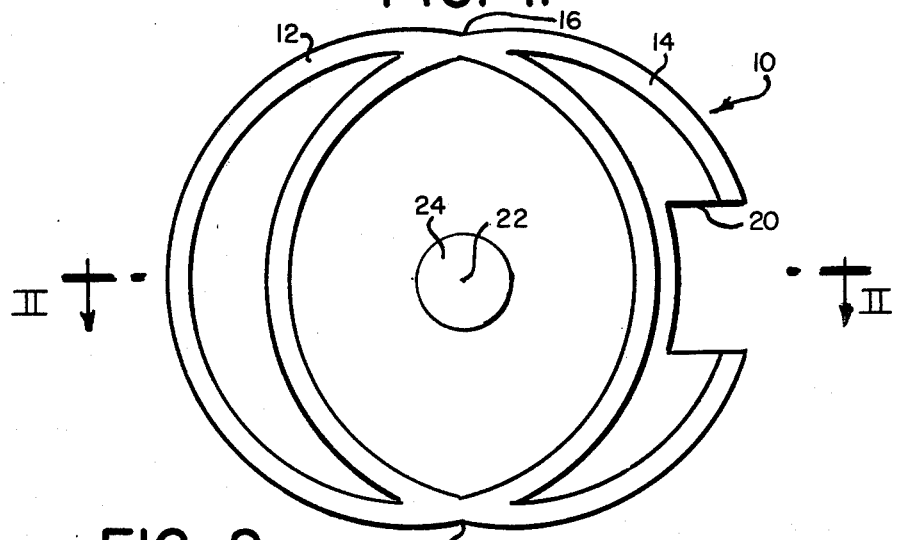
FIG. 1 is a top view of a cup lid according to an embodiment of the invention.

Referring now to FIG. 1, there is shown, generally at 10, a cup lid according to an embodiment of the invention. Cup lid 10 is preferably molded of any suitable material but most preferably of impervious plastic material suitable for containing a material in the cup (not shown).

A first circular sealing flange 12 includes a continuous perimeter which, when pressed over the lip of a cup (not shown) seals the cup against spillage of liquid therefrom.

A second sealing flange 14 intersects sealing flange 12 at intersections 16 and 18 to form a figure-8 outline. An opening 20 intersecting sealing flange 14 and extending part way toward sealing flange 12 permits the contents of a cup (not shown) to be dispensed.

A conventional pinhole-type vent centered in an upward protuberance 24 provides pressure equalization between outside and inside a cup without losing substantial fluid. Since such pinhole-type vents are conventional and do not form a part of the present invention, this feature will not be further described.

Figure 2:
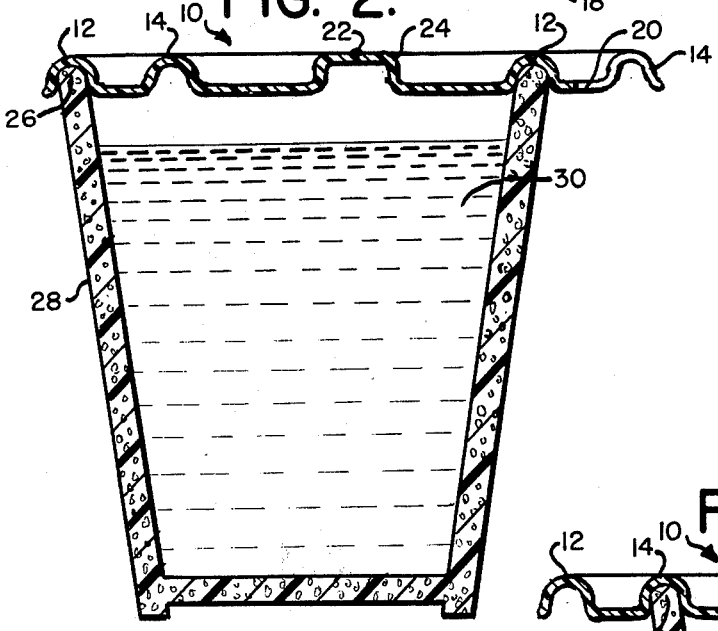
FIG. 2 is a cross section of a cup and cup lid wherein the cup lid is installed in its sealing position.

Referring now to FIG. 2, cup lid 10 is shown with its continuous sealing flange 12 sealingly installed over a lip 26 of a cup 28. Although cup 28 is shown as a molded-foam structure, this is not a necessary part of the invention since cup 28 may be made of paper, non-foamed plastic, or other material. A liquid 30 within cup 28 is contained therein by the continuous seal provided by sealing flange 12 about lip 26. The presence of sealing flange 14 does not interfere with the function of sealing flange 12.

Figure 3:
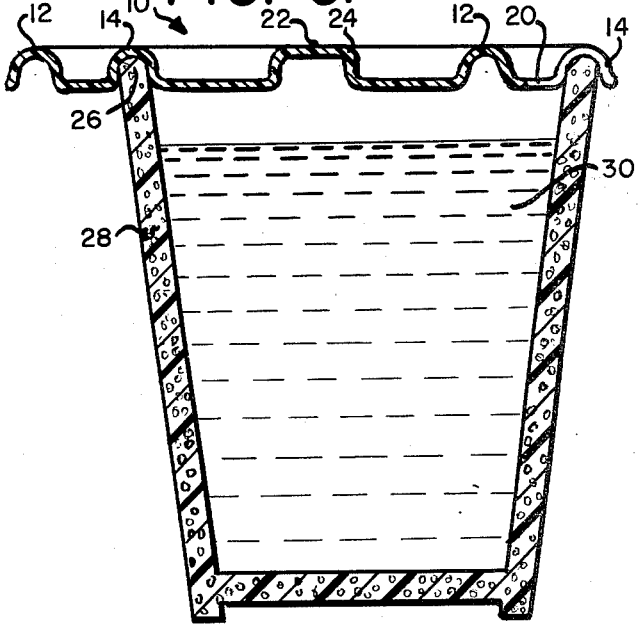
FIG. 3 is a cross section of a cup and cup lid wherein the cup lid is installed in its dispensing position.

Referring now to FIG. 3, cup lid 10 is shown in its alternate position wherein sealing flange 14 is installed on lip 26 of cup 28. In this position, opening 20 is available for dispensing liquid 30.

If it is desired to again seal cup 28, lid 10 can be disengaged from its dispensing position shown in FIG. 3 and re-engaged in its sealing position shown in FIG. 2.

Although cup 28 is shown containing liquid 30, it should not be assumed that the present invention is limited to sealing such material. For example, cup 28 may contain semi-liquid, granular-solid or any other material which it is desired to alternately seal or dispense using the capability provided by cup lid 10.

Having described a specific preferred embodiment of the invention with reference to the accompanying drawings, it is to be understood that the invention is not limited to this precise embodiment and that various changes and modifications may be effected therein by one skilled in the art without departing from the scope or spirit of the invention as defined in the appended claims.

What is claimed is:

1. A cup lid for fitting the lip of a cup comprising a first circular sealing flange fittable over an entire circumference of said lip and effective to seal said cup against spillage of spillable material therefrom, a second circular sealing flange intersecting said first circular sealing flange fittable over said lip and forming together with said first circular sealing flange a figure-8 outline, an opening in said cup lid outside said first circular sealing flange and inside said second circular sealing flange, said opening being effective to dispense material from said cup when said second circular flange is fitted over said lip.

2. A cup lid according to claim 1, wherein said opening interrupts said second circular flange.

3. A cup lid according to claim 1, wherein said cup lid is molded plastic.

* * * * *